United States Patent [19]

Person

[11] Patent Number: 4,998,727

[45] Date of Patent: Mar. 12, 1991

[54] ATHLETIC TRAINING TIMER

[76] Inventor: Mel N. Person, 506 N. 4th St., Fruitland, Id. 83619

[21] Appl. No.: 255,442

[22] Filed: Oct. 11, 1988

[51] Int. Cl.[5] ..... A63B 67/00

[52] U.S. Cl. ..... 273/55 R; 273/55 B; 273/16 E; 434/251

[58] Field of Search ..... 273/55 R, 55 B, 176 FA, 273/1 GC, 1 GE; 128/746; 434/247, 251, 258

[56] References Cited

U.S. PATENT DOCUMENTS

| | | | |
|---|---|---|---|
| 2,630,171 | 3/1953 | Allgaier | 273/1 GE |
| 2,861,141 | 11/1958 | De Brocke | 273/55 B |
| 3,700,238 | 10/1972 | Mathis | 273/55 R |
| 4,502,489 | 3/1985 | Alston, Jr. | 128/746 |
| 4,627,620 | 12/1986 | Yang | 273/1 GE |
| 4,645,458 | 2/1987 | Williams | 434/251 |
| 4,775,151 | 10/1988 | Berry | 273/55 R |

OTHER PUBLICATIONS

Stoner, Dawn, "What's New-Football Feedback", Popular Science, Jan. 1989, p. 94.

*Primary Examiner*—Edward M. Coven
*Assistant Examiner*—Jessica J. Harrison
*Attorney, Agent, or Firm*—Frank J. Dykas; Craig M. Korfanta

[57] ABSTRACT

An athletic training timer (10) including a selectable time-delay timer (11), a selectable signal duration timer (12), buzzer (14), a power supply (16) for powering the circuit and a remote foot switch (15) which is adapted to be activated by an athlete initiating play.

3 Claims, 4 Drawing Sheets

ATHLETIC TRAINING TIMER

BACKGROUND OF THE INVENTION

1. Technical Field

This invention generally relates to timing devices for use in athletics, in particular, to a timing device for use in athletics which is activated by the athlete and which provides audible feedback to help the athlete improve his or her sense of timing.

2. Background Art

Almost any athlete can verify the importance of timing in succeeding in athletics. In football, receivers rely on timing to catch a pass thrown by the quarterback, who previously timed his pass-release of the football, while the linemen, in turn, rely on their own sense of timing so that they may proceed down field after the football has been thrown by the quarterback. In baseball, base runners rely on timing when trying to steal a base, as they know that, on the average, if they have not reached the base within a known period of time, chances are the catcher will have "thrown them out". Basketball players are continuously trying to beat the thirty second clock and game clock with last second shots.

Coaches spend a great deal of their time, with stopwatch in hand, providing the athlete with feedback as to when and where the athlete must be at any given time. This process consumes the attention of the coach, making it difficult for the coach to concentrate on other crucial aspects of the game. If a timing device were available which initiated a timing sequence at the beginning of an athletic event and provided an audible feedback signal at the end of a selectable time period, all without the attention of the coach, the coach would be able to direct his attentions elsewhere. Likewise, the athlete could practice his timing absent of the coach.

WILLIAMS, U.S. Pat. No. 4,645,458 teaches an athletic evaluation and training apparatus for testing and enhancing a football player's ability to quickly react to visual stimuli. The device consists of two timers, controlled by optical switching means, and a plurality of visual stimuli which provide an indication to the player as to his next course of action. The first timer is used to keep track of how quickly any given athlete reaches a first decision point within the timed sequence. The second timer evaluates the swiftness of the athlete in completing the entire sequence of events. The device and method as taught by Williams, is used solely for evaluating an athlete's performance in an artificial environment.

What is needed is a timing apparatus for use within the natural environment of a particular athletic event which provides audible feedback to the athlete during the course of play to enhance the athlete's timing abilities. Timing ability relates to the ability of one player to correlate his actions with the actions of another player, i.e. a quarterback throwing an on target pass, while the receiver is still running the pattern, and the receiver, in turn, turning to catch the ball at exactly the right moment.

Accordingly, it is an object of the present invention to provide a timing apparatus which can be used on the athletic playing field and provides an audible signal to the athletes. It is a further object of the present invention to provide a timer which is activated by the natural motion of an athlete at the beginning of athletic play. Other objects of the present invention are to provide a timer which delays the audible signal activation for a selectable period of time after the timer has been activated and, further, a timer which provides an audible signal of selectable duration.

DISCLOSURE OF INVENTION

These objects are accomplished by a timing circuit including a selectable time-delay timer, a selectable signal duration timer, an audible signal means such as a piezoelectric buzzer, a power supply means for powering the circuit and a remote foot switch which is adapted to be activated by an athlete initiating play.

The foot switch is made from a resilient and durable material, such as acrylic plastic. A switch plate is hinged to a base plate and spring biased between first and second positions. The switch plate has an electrical switch activator arm connected thereto which serves to activate an electrical switch located on the base plate. The switch plate is spring biased to be normally in the second position which corresponds to a closed position for the electrical switch.

In use, the electrical circuit is responsive to a transition of the foot switch from the first position to the second position. The first position of the foot switch has the switch plate essentially parallel to the base plate, while the second position, has the switch plate separated from the base plate by an angular space. In this manner, the circuit is activated by the movement from the foot switch by the athlete. The switch plate can further be adapted to hold a playing ball, such as a football, soccer ball, or the like.

BEST MODE FOR CARRYING OUT INVENTION

Figure 1:
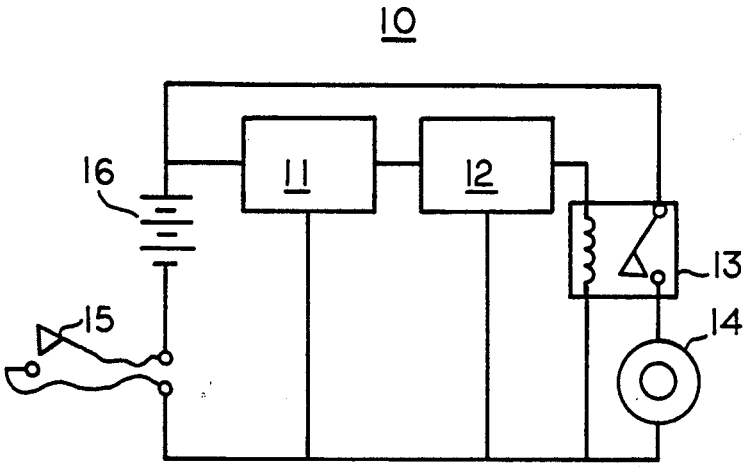
FIG. 1 is a block circuit diagram of an athletic training timer.

FIG. 1 shows athletic training timer 10 in block circuit schematic form. Athletic training timer 10 has a selectable time delay timer 11 electrically connected to a selectable signal duration timer 12 and, in turn, serially connected with the actuation coil of relay 13. Relay 13 controls an audible signal means 14, such as a buzzer. Selectable time delay timer 11 is responsive to a foot switch 15 which may be remotely located. A portable power supply 16, such as a battery, is provided for powering the circuit.

Figure 2:
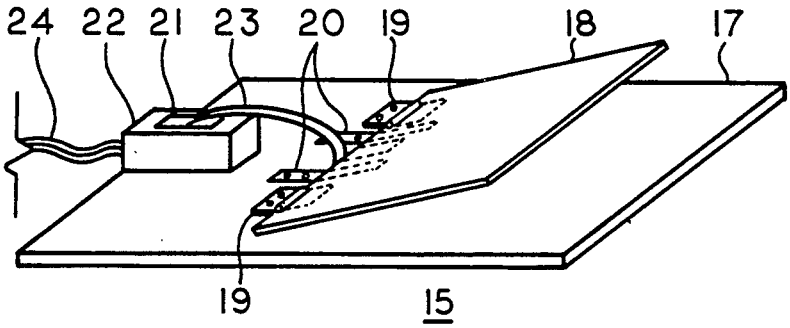
FIG. 2 is a perspective view of a foot switch.

Foot switch 15 is shown in FIG. 2 and has switch plate 18 hinged to base plate 17 via hinges 19. Switch plate 18 swings between a first position and second position, wherein the first position has switch plate 18 disposed essentially parallel to base plate 17 and the second position has switch plate 18 separated from base plate 17 by an angular space. Switch plate 18 is spring biased to be normally in the second position, by biasing springs 20. In this particular embodiment, biasing springs 20 are each single metal strips attached to base plate 17 and having a portion depending angularly upward, supporting switch plate 18. A switch activator arm 23 is attached to switch plate 18 and mechanically activates electrical switch 21 which is supported by switch block 22. Switch block 22 is attached to base plate 17. A remote connector 24 is provided to connect electrical switch 21 with the timing circuit.

Figure 3:
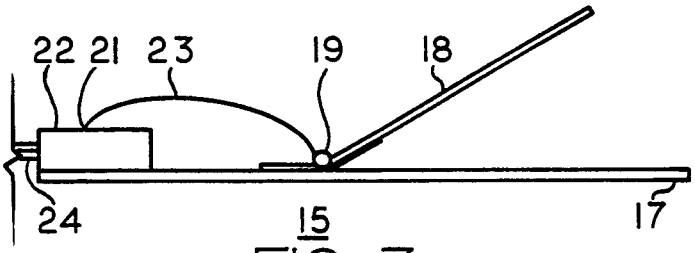
FIG. 3 is a side view showing the foot switch in the second position.
Figure 4:
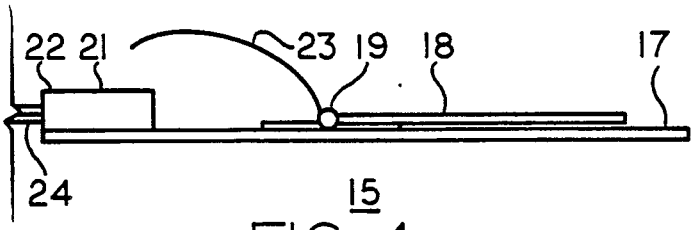
FIG. 4 is a side view showing the foot switch in a first position.

Referring now to FIG. 3, foot switch 15 is shown in the second position which has switch plate 18 and base plate 17 separated by an angular space. Activator arm 23 is shown activating electrical switch 21. FIG. 4 shows foot switch 15 in the first position wherein activator arm 23 is no longer activating electrical switch 21.

Figure 5:
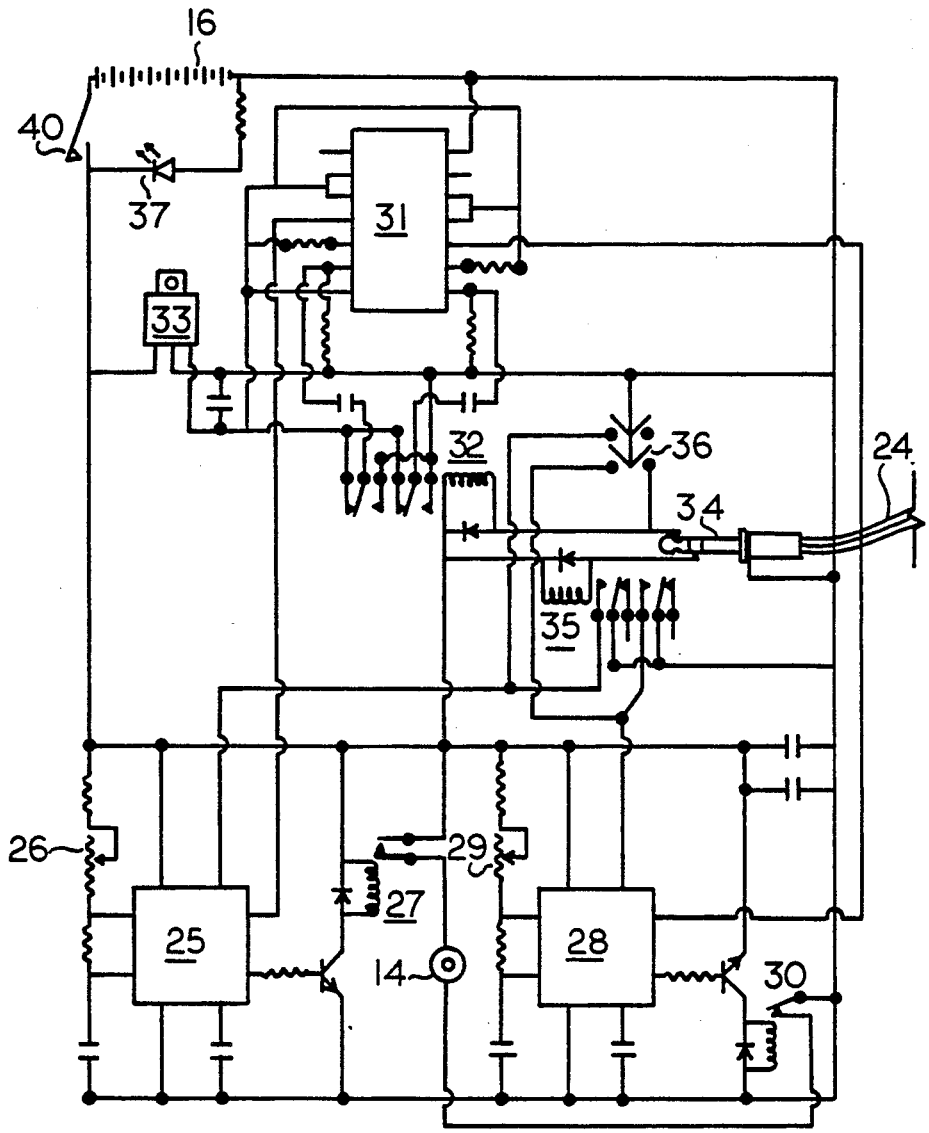
FIG. 5 is a detailed circuit schematic of the athletic training timer circuit.

Referring now to FIG. 5, a detailed circuit schematic of the athletic training timer circuit is shown. A selectable time delay is carried out by delay timer 25, which consists of a 555 timing IC. A means for selecting the time delay period is provided by a potentiometer 26. The output of delay timer 25 controls normally open relay 27 which subsequently connects or disconnects buzzer 14 to the positive terminal of power supply 16. The signal duration timing function is carried out by duration timer 28, which again consists of a 555 timing IC connected to a potentiometer 29. Potentiometer 29 provides means for selecting the duration of the audible signal provided by buzzer 14. The output of duration timer 28 controls normally closed relay 30 which connects and disconnects buzzer 14 to the ground side of power supply 16.

Both delay timer 27 and duration timer 28 are triggered by AND gate IC 31 in connection with double pull double throw (DPDT) relay 32, which initiates the timing sequence. Digital voltage regulator 33 is connected to power supply 16 and provides a suitable voltage source for AND gate IC 31. DPDT relay 32 is actuated by a signal applied to its actuation coil by either stereo phono plug 34 or three-way toggle 36. Phono plug 34 is connected to the foot switch (not shown in FIG. 5) via remote connector 24. DPDT relay 32 is responsive to a transition of the foot switch from the first to the second positions. In the absence of a foot switch, an initiation signal can be applied via three-way toggle 36. Three-way toggle 36 has one position corresponding to a reset actuation position, hereinafter explained, and another position corresponding to an idle or no action position and the third position corresponding to a timing sequence initiate position.

Reset relay 35, again a DPDT relay, generates a reset signal, from the foot switch, to delay timer 25 and duration timer 28 responsive to the first position of the foot switch. In the absence of a foot switch, the reset signal is provided to delay timer 25 and duration timer 28 by three-way toggle 36. LED 37 is connected across power supply 16 and will light upon closing of on/off switch 40.

A particularly useful application, especially for the purpose of example, is that of football player training. The foot switch of FIG. 2 is positioned on the football field to be activated by either the quarterback's foot or the center snapping the ball. To be activated by the center, the center would simply hold the football on switch plate 18 prior to initiation of play. Upon snapping the ball, switch plate 18 will make a transition from the first position to the second position and thereby activating both delay timer 25 and duration timer 28. Since both delay timer 25 and duration timer 28 are, in this embodiment, both activated at the same time, duration timer 28 must necessarily have a time period selected to be longer than that of delay timer 25. After activation of the timing sequence, the player has a preselected time to initiate a specific action. At the end of the preselected time, athletic training timer 10 will activate an audible signal which alerts the athlete to the expiration of the initial delay period. The audible signal will then continue for a selected period of time until the signal duration timer 28 times out. The audible signal will then cease. A simple example would be to set delay timer 25 for two seconds and duration timer 28 for three seconds. Upon snapping the ball, the quarterback has two seconds to drop back and set up for the pass. At the end of the two seconds, delay timer 25 will time out and activate audible signal means 14. The quarterback then has one second to release the pass, as the duration timer was set for three seconds so the audible signal will continue for one second. The audible signal also alerts the receiver that the pass is about to be thrown and he should therefore be approaching the designated target area.

Figure 6:
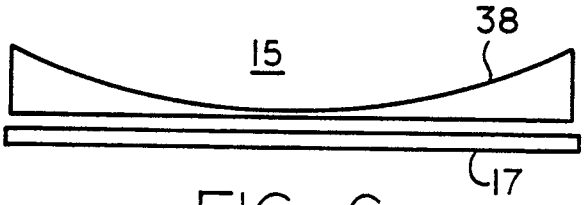
FIG. 6 is an end view showing a concave switch plate.
Figure 7:
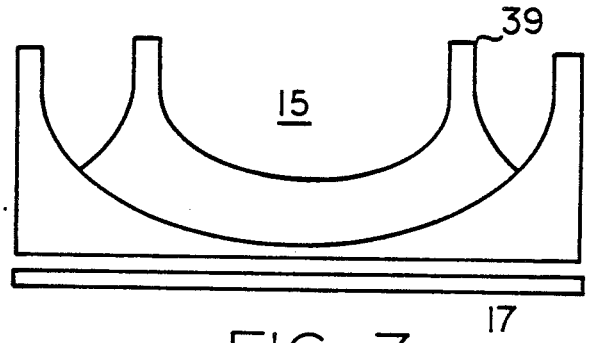
FIG. 7 is an end view showing a switch plate adapted in the shape of a ball tee.

Foot switch 15 can be adapted to hold various sports balls, as is shown in FIGS. 6 and 7. FIG. 6 shows foot switch 15 having a concave switch plate 38 while FIG. 7 shows foot switch 15 having a tee shaped switch plate 39.

While there is shown and described the present preferred embodiment of the invention, it is to be distinctly understood that this invention is not limited thereto but may be variously embodied to practice within the scope of the following claims.

I claim:

1. An athletic training timer which comprises:

a foot switch, for use on a playing field, having first and second positions, said foot switch having a base plate being placed in direct contact with the playing field, a switch plate hinged to said base plate, wherein said first position has said switch plate disposed essentially parallel to said base plate and said second position has said switch plate and said base plate separated by an angular space, an electrical switch operably attached to said base plate and said switch plate, said electrical switch being configured to be responsive to said first and second positions to close and complete an electrical connection in said second position and means for remotely connecting said electrical switch to an audible signal means;

a timer remotely connected to said foot switch and operable to initiate a timing sequence responsive to a transition of the switch from the first position to the second position, and further operably connected to an audible signal means for activating the audible signal means after a selectable period of time;

means for selecting said period of time being operably connected to said timer;

means for producing a continuous audible signal for a selectable duration of time;

means for selecting the duration of audible signal time being operably connected to said audible signal means; and means for supplying power to said timer and said audible signal means.

2. The timer of claim 1 wherein said foot switch is spring biased to be normally in the second position and configured to be held in the first position by an athlete prior to the initiation of athletic play.

3. The foot switch of claim 2 wherein said switch plate and said base plate are each flat and planar in shape.

* * * * *